US009272278B2

(12) United States Patent
Daub et al.

(10) Patent No.: US 9,272,278 B2
(45) Date of Patent: Mar. 1, 2016

(54) CARTRIDGE, CENTRIFUGE AND METHOD

(75) Inventors: Martina Daub, Weissach (DE); Juergen Steigert, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 877 days.

(21) Appl. No.: 13/490,942

(22) Filed: Jun. 7, 2012

(65) Prior Publication Data

US 2012/0316050 A1 Dec. 13, 2012

(30) Foreign Application Priority Data

Jun. 7, 2011 (DE) ..... 10 2011 077 124

(51) Int. Cl.

| | |
|---|---|
| ***B01L 3/00*** | (2006.01) |
| ***B01F 9/00*** | (2006.01) |
| ***B01F 11/04*** | (2006.01) |
| ***B01F 13/08*** | (2006.01) |
| ***B01F 15/02*** | (2006.01) |

(52) U.S. Cl.

CPC ..... *B01L 3/5021* (2013.01); *B01F 9/002* (2013.01); *B01F 9/0003* (2013.01); *B01F 11/04* (2013.01); *B01F 13/0854* (2013.01); *B01F 15/0212* (2013.01); *B01F 15/0223* (2013.01); *B01F 15/0233* (2013.01); *B01L 2200/16* (2013.01); *B01L 2300/0672* (2013.01); *B01L 2300/0841* (2013.01); *B01L 2400/0409* (2013.01)

(58) Field of Classification Search

CPC .... B01F 11/04; B01F 13/0854; B01F 5/0212; B01F 5/0223; B01F 9/0003; B01F 9/002; B01L 2200/16; B01L 2300/0672; B01L 2300/0841; B01L 2400/0409; B01L 3/5021

See application file for complete search history.

(56) References Cited

U.S. PATENT DOCUMENTS

| | | | | |
|---|---|---|---|---|
| 5,707,331 | A * | 1/1998 | Wells et al. | 494/20 |
| 2009/0023610 | A1 | 1/2009 | Peytavi | |

FOREIGN PATENT DOCUMENTS

| | | | |
|---|---|---|---|
| DE | 10 2004 023 427 | A1 | 12/2005 |
| DE | 10 2006 003 532 | A1 | 7/2007 |
| EP | 2 514 515 | A1 | 10/2012 |
| EP | 2 532 427 | A2 | 12/2012 |
| EP | 2 532 458 | A1 | 12/2012 |
| EP | 2 535 108 | A1 | 12/2012 |
| JP | 2008-224383 | A | 9/2008 |
| WO | 2009/142087 | A1 | 11/2009 |

* cited by examiner

*Primary Examiner* — Timothy Cleveland

(74) *Attorney, Agent, or Firm* — Maginot, Moore & Beck LLP

(57) ABSTRACT

A cartridge is configured for insertion and centrifugation in a centrifuge. The cartridge includes a first drum which has a first chamber, and a displacement device which is designed to rotate the first drum about a center axis thereof to selectively and conductively connect the first chamber to a second or a third chamber. In another embodiment, the cartridge includes a first drum which has a first chamber and a second chamber, and a displacement device which is designed to rotate the first drum about the center axis thereof to selectively and conductively connect the first chamber to a third chamber or the second chamber to the third chamber. The displacement device has an actuator which directly or indirectly moves the first drum about the center axis.

14 Claims, 16 Drawing Sheets

CARTRIDGE, CENTRIFUGE AND METHOD

This application claims priority under 35 U.S.C. §119 to patent application no. DE 10 2011 077 124.7, filed on Jun. 7, 2011 in Germany, the disclosure of which is incorporated herein by reference in its entirety.

BACKGROUND

Biochemical processes are carried out in particular on the basis of the handling of liquids. This handling is typically carried out manually using additional aids, such as pipettes, reaction vessels, active probe surfaces or laboratory equipment. These processes are already automated in part by pipette robots or by special equipment.

Lab-on-a-chip systems place the entire function of a macroscopic laboratory on a plastics substrate which is merely the size of a plastic card. Lab-on-a-chip systems typically consist of two main components. A test substrate contains structures and mechanisms for implementation of basic fluid operations (for example mixers), which may consist of passive components, such as ducts, reaction chambers and upstream reagents, or of active components, such as valves or pumps. The second main components are actuation, detection and control units. Such systems make it possible to carry out biochemical processes in a fully automated manner.

A lab-on-a-chip system is described for example in document DE 10 2006 003 532 A1. This system comprises a rotor chip, which is rotatable with respect to a stator chip. The rotor chip can be coupled by means of fluidic ducts to the stator chip for filling or emptying of the rotor chip.

SUMMARY

Compared to conventional solutions, the cartridge, the centrifuge, and the method have the advantage that at least one component in the cartridge can be processed independently of the rotational speed of the centrifuge.

That is to say, in the first variant, in which the first drum comprises the first chamber, the first and second chamber or the first and third chamber can be interconnected conductively by actuation of the actuator. In addition, the actuation can also be assisted by the centrifugal force.

For example, in the first variant at least one first component is held in the second chamber and at least one second component is held in the third chamber. The first chamber is connected conductively to the second chamber by actuation of the actuator, and the first component is hereafter transferred from the second chamber into the first chamber due to the action of the centrifugal force. Hereafter, the first chamber is again connected to the third chamber by actuation of the actuator, and the second component flows hereafter likewise into the first chamber, for example so as to be mixed with the first component.

Alternatively, in the first variant, a single component could also be contained in the first chamber however. The first chamber is first connected conductively to the second chamber by actuation of the actuator, and a specific proportion of the component is filled into the second chamber. Hereafter, the first chamber is connected conductively to the third chamber and a further proportion of the component is filled into the third chamber.

That is to say, in the second variant, in which the first drum comprises the first and the second chamber, the first and third chamber or the second and third chamber can be interconnected conductively by actuation of the actuator. In addition, the actuation can also be assisted by the centrifugal force.

For example, in the second variant, at least one first component is held in the first chamber and at least one second component is held in the second chamber. The first chamber is connected conductively to the third chamber by actuation of the actuator, and the first component is hereafter transferred from the first chamber into the third chamber due to the action of the centrifugal force. Hereafter, the second chamber is again connected to the third chamber by actuation of the actuator, and the second component flows hereafter likewise into the third chamber, for example so as to be mixed with the first component.

Alternatively, in the second variant, a single component could also be contained in the third chamber however. The first chamber is first connected conductively to the third chamber by actuation of the actuator, and a specific proportion of the component is filled into the first chamber. Hereafter, the second chamber is connected conductively to the third chamber, and a further proportion of the component is filled into the second chamber.

The first and second variants can also be combined.

Advantageous embodiments of the disclosure will emerge from the dependent claims.

In the present case, "component" means a liquid, a gas, or a particle.

In the present case, "chamber" preferably means a line portion which is open on either side or merely on one side, as well as a substantially closed space which has a feed and/or discharge.

In the present case, "selectively" is understood to mean that the first chamber is connected either to the second or to the third chamber (first variant), or either that the first chamber is connected to the third chamber or that the second chamber is connected to the third chamber (second variant) according to actuation by the actuator.

According to an embodiment of the cartridge according to the disclosure, the actuator is operated electrically, mechanically and/or by pressure. In particular, a piezoelectrically, electrostatically, semi-mechanically/manually or electromagnetically operated actuator can be considered. Operated by pressure means that the actuator actuates the first drum by utilization of a gas pressure or liquid pressure.

According to an embodiment of the cartridge according to the disclosure, the actuator has a control element, which is connected to the first drum so as to rotate it directly and, where necessary, to move it along the center axis. Reliable, direct actuation of the first drum is thus provided, wherein use of the "ballpoint mechanism" described hereinafter is omitted. In this case, "direct(ly)" means that no further mechanical elements are arranged in-between for implementation of the movement, as opposed to "indirect(ly)".

According to an embodiment of the cartridge according to the disclosure, the actuator has a control element, which is connected to the first drum so as to move it along the center axis and thus rotate it. The control element preferably actuates the ballpoint mechanism described hereinafter, whereupon the ballpoint mechanism rotates the first drum. The first drum is therefore actuated indirectly.

According to an embodiment of the cartridge according to the disclosure, the displacement device comprises a first slanted edge, which cooperates with a second slanted edge of the first drum so as to bring the drum out of a first position, in which it engages with a positive fit with a housing of the cartridge in the direction of rotation about the center axis, and into a second position along the center axis, in which the positive fit is annulled and the first drum rotates about the center axis due to the action of a restoring means or of the actuator or of a further actuator. A ballpoint mechanism is thus provided.

According to an embodiment of the cartridge according to the disclosure, the actuator actuates the first slanted edge for cooperation with the second slanted edge. The actuator preferably moves the first slanted edge along the center axis in a direction away from the center of rotation of the cartridge of the centrifuge.

According to an embodiment of the cartridge according to the disclosure, a second drum is arranged upstream or downstream of the first drum, based on the center axis, the actuator actuating the second drum so as to rotate the first drum. The first drum is thus actuated indirectly by means of the second drum.

According to an embodiment of the cartridge according to the disclosure, the actuator lies against the first and/or second drum to press thereagainst in a planar manner, or the actuator is connected rigidly to the first or second drum. The embodiment in accordance with which the actuator lies against the first and/or second drum so as to press thereagainst in a planar manner is characterized by simple design and simple assembly. The rigid connection between the first or second drum and the actuator has the advantage that the actuator can move the first or second drum in opposite directions.

According to an embodiment of the cartridge according to the disclosure, the actuator is arranged between the first and second drum. In addition, the actuator is preferably formed as a piezoelectric element.

According to an embodiment of the cartridge according to the disclosure, the cartridge has a housing, which is sealed at one end by means of an adapter, the actuator being fastened to the adapter. A number of functions are thus integrated into the adapter: namely, in particular, sterile sealing of the housing and also the accommodation of the actuator. The actuator is preferably integrated into the adapter.

According to an embodiment of the cartridge according to the disclosure, the adapter has a flexible membrane, which can be actuated on one side by means of the actuator and which, on its other side, acts on the first drum or on the second drum. A more sterile closure is thus provided. The actuator is therefore preferably arranged outside the interior of the housing.

According to an embodiment of the cartridge according to the disclosure, the second and/or third chamber is/are arranged upstream or downstream of the first drum, based on the center axis, and/or is/are formed in the second drum. For example, a second chamber can also be arranged upstream of the first drum, and a third chamber can be arranged downstream of the first drum. In particular, the second chamber is provided in the second drum and the third chamber is provided in a third drum.

According to an embodiment of the cartridge according to the disclosure, the actuator is arranged in front of or behind the first drum, based on a center of rotation of the cartridge in the centrifuge. If the actuator is arranged behind the first drum, based on the center of rotation, no other restoring means is necessary, which is advantageous, the actuator itself forming a restoring means. The first drum is actuated by the actuator in combination with the centrifugal force.

BRIEF DESCRIPTION OF THE DRAWINGS

Exemplary embodiments of the disclosure are illustrated in the figures of the drawing and will be explained in greater detail in the following description.

In the figures.

DETAILED DESCRIPTION

In the figures, like or functionally like elements are denoted by like reference signs, unless stated otherwise.

Figure 1:
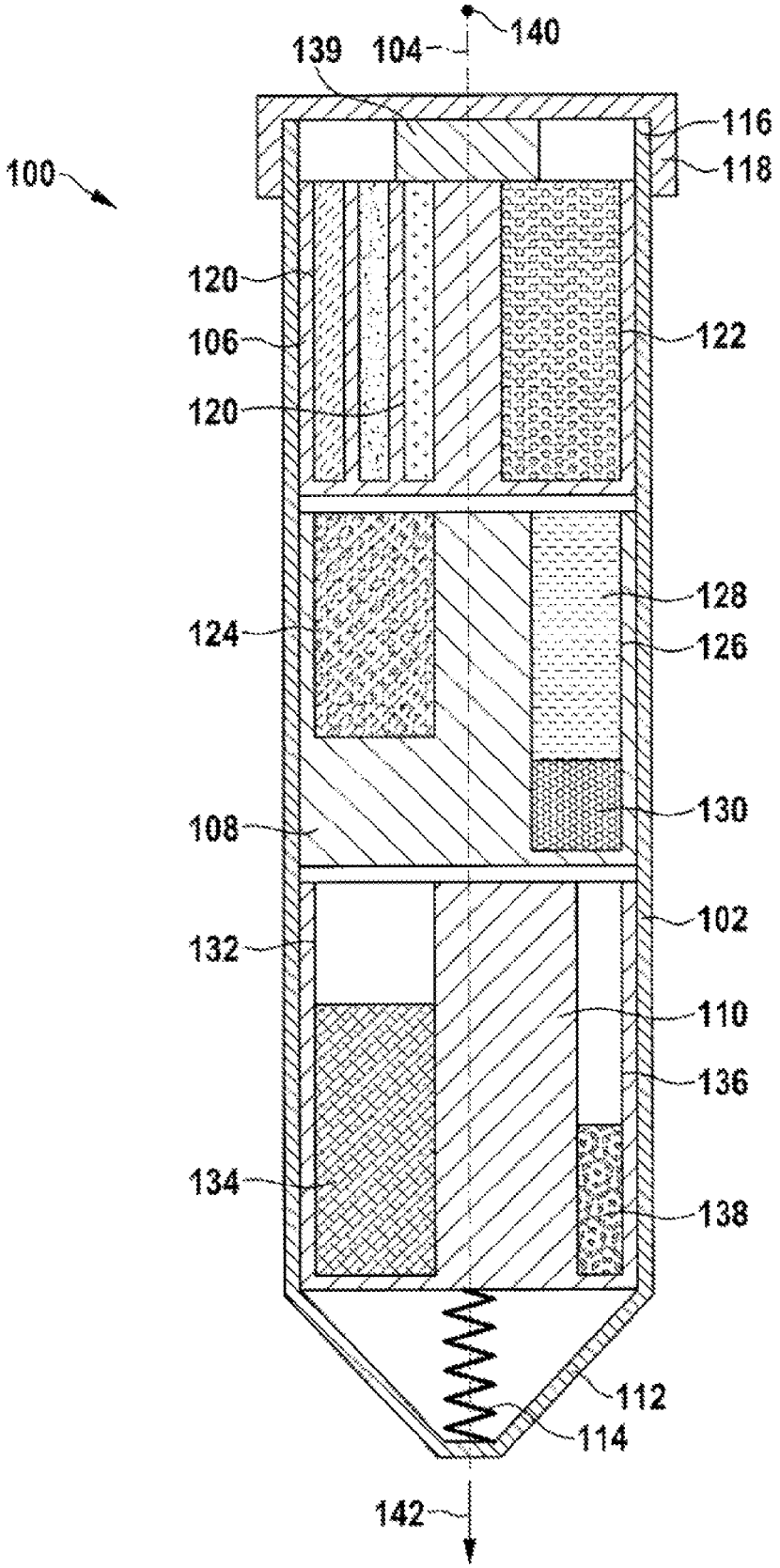
FIG. 1 shows a schematic sectional view through a cartridge in accordance with an exemplary embodiment of the present disclosure.

FIG. 1 shows a sectional view of a cartridge 100 in accordance with an exemplary embodiment of the present disclosure.

The cartridge 100 comprises a housing 102 in the form of a tube. For example, the housing 102 may be formed as a 15 mL centrifuge tube, 1.5 mL or 2 mL Eppendorf tube, or alternatively as a micro titer plate (for example 20 μL per well). The longitudinal axis of the housing 102 is denoted by 104.

For example, a first drum 108, a second drum 106 and a third drum 110 are received in the housing 102. The drums 106, 108, 110 are arranged in succession and with their respective center axes coaxially aligned with the longitudinal axis 104.

The housing 102 is closed at one end 112. A restoring means, for example in the form of a spring 114, is arranged between the closed end 112 and the drum 110 arranged adjacent thereto. The spring 114 can be formed as a spiral spring or as a polymer, in particular an elastomer. The other end 116 of the housing 102 is sealed by means of a seal 118. The seal 118 can preferably be removed so as to remove the drums 106, 108, 110 from the housing 102. Alternatively, the housing 102 itself can also be disassembled so as to remove the drums 106, 108, 110 or to reach the chambers, for example the chamber 136.

According to a further exemplary embodiment, the spring 114 is arranged between the seal 118 and the drum 106, and therefore the spring 114 is extended to produce a restoring force. Other arrangements of the spring 114 are also conceivable.

A respective drum 106, 108, 110 can have one or more chambers:

For example, the second drum 106 thus comprises a plurality of chambers 120 for reagents and a further chamber 122 for receiving a sample, for example a blood sample, which has been taken from a patient.

The first drum 108, which is arranged downstream of the second drum 106, comprises a mixing chamber 124, in which the reagents from the chambers 120 are mixed with the sample from the chamber 122. In addition, the first drum 108 comprises a chamber 126 for example, in which the mixture from the mixing chamber 124 is separated into a liquid and a solid phase 128 and 130 respectively. The solid phase 130 may be a gel column, a silica matrix or a filter.

The third drum 110, again arranged downstream of the first drum 108, comprises a chamber 132 for receiving a waste product 134 from the chamber 126. Furthermore, the third drum 110 comprises a further chamber 136 for receiving the desired end product 138.

The cartridge 100 has an external geometry such that it can be inserted into a seat in a rotor of a centrifuge, in particular into a seat in a swing-out rotor or fixed-angle rotor of a centrifuge. During the centrifugation process, the cartridge 100 is rotated at high speed about a center of rotation 140 indicated schematically in FIG. 1. The center of rotation 140 lies on the longitudinal axis 104, and therefore a corresponding centrifugal force 142 acts along the longitudinal axis 104 on each element of the cartridge 100.

The objective is to control different processes within the cartridge 100 by means of an actuator 139. For example, the mixing chamber 124 is first to be connected fluidically to the chamber 122 so as to receive the sample from the chamber 122. Hereafter, the mixing chamber 124 is to be connected to the chambers 120 so as to receive the reagents therefrom. The reagents and the sample are then to be mixed in the mixing chamber 124. The processes in the chambers 126, 132 and 136 are also to be controlled in a similar manner. The rotational speed of the centrifuge or of a rotor thereof can also be controlled accordingly, in addition to the control of the processes by means of the actuator 139. In particular, the object of the effective centrifugal force 142 is to transfer the components, that is to say for example the sample or the reagents, between the chambers 120, 122 and the mixing chamber 124.

FIGS. 2A to 2G show perspective views of different parts of the cartridge 100 from FIG. 1. In particular, a displacement device 300 (see FIG. 3A) comprising the actuator 139, which makes it possible to control the above-mentioned processes, will be explained hereinafter with reference to FIGS. 2A to 2G.

Figure 2A:
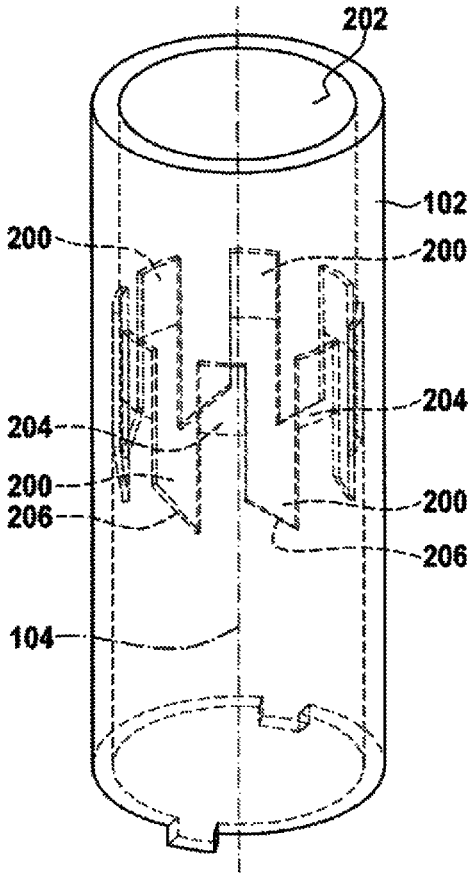
FIGS. 2A to 2G show perspective views of different parts of the cartridge from FIG. 1.

As shown in FIG. 2A, the housing 102 has protrusions 200 on its inner face. The protrusions 200 protrude radially towards the longitudinal axis 104 from the inner wall 202 of the housing. The protrusions 200 form slits 204 therebetween, which extend along the longitudinal axis 104. The protrusions 200 are each formed with a slanted edge 206 at one end. The slanted edges 206 point away from the center of rotation 140 during operation of the centrifuge with the cartridge 100.

Figure 2B:
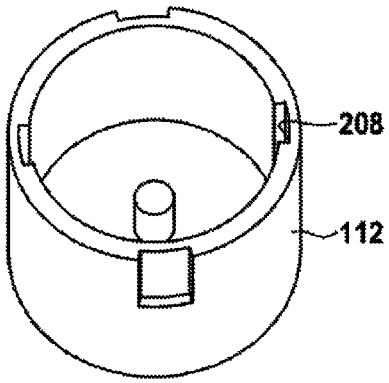

FIG. 2B shows the end 112 of the housing 102, said end, according to this exemplary embodiment, being formed as a removable cap. The end 112 has a plurality of grooves 208 in its inner circumference, said grooves extending along the longitudinal axis 104.

Figure 2C:
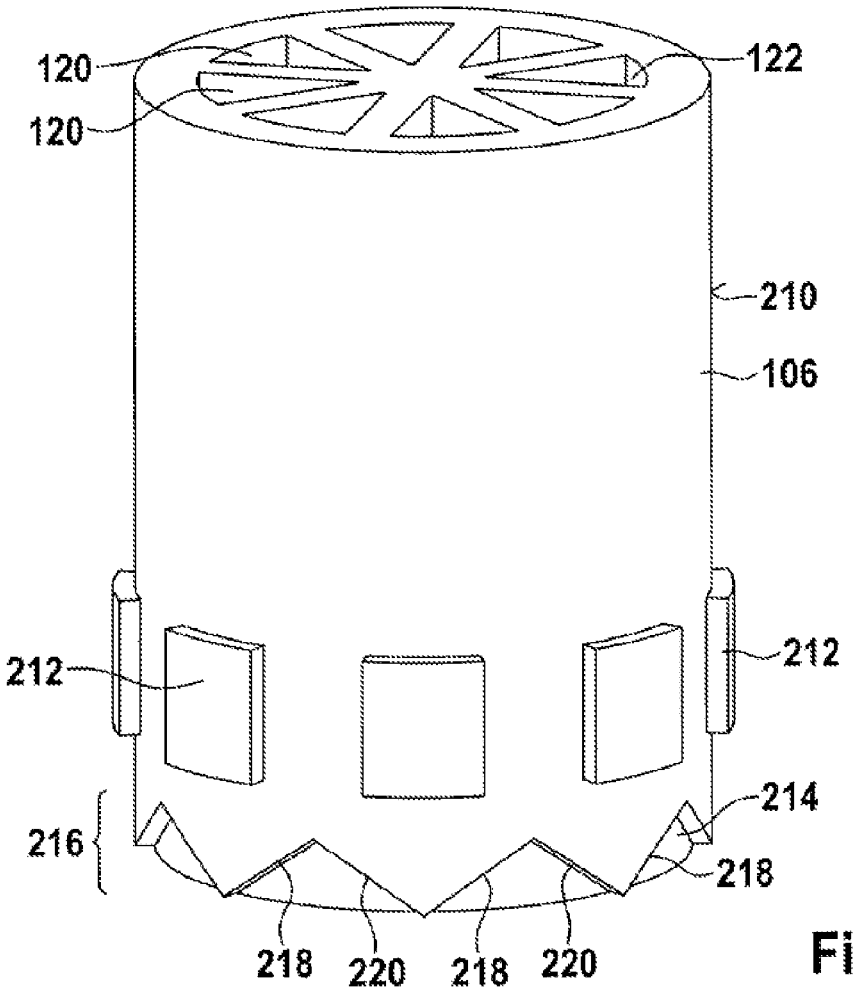

FIG. 2C shows the second drum 106 with the chambers 120, 122. The drum 106 has a plurality of protrusions 212 on its outer wall 210, said protrusions extending radially outwardly from the outer wall 210. When the cartridge 100 is assembled, the protrusions 212 of the drum 106 engage in the slits 204 in the housing 102. The drum 106 is thus blocked against rotation about the longitudinal axis 104. However, the drum 106 is displaceable along the longitudinal axis 104 in the slits 204. The second drum 106 further has a crown-like contour 216 on its outer wall 210, in particular at its end 214 facing the first drum 108, said contour comprising a multiplicity of slanted edges 218, 220. Every two slanted edges 218, 220 form an indent of the crown-like contour 216. The slanted edges 218, 220 likewise point away from the center of rotation 140 during operation of the centrifuge with the cartridge 100.

Figure 2D:
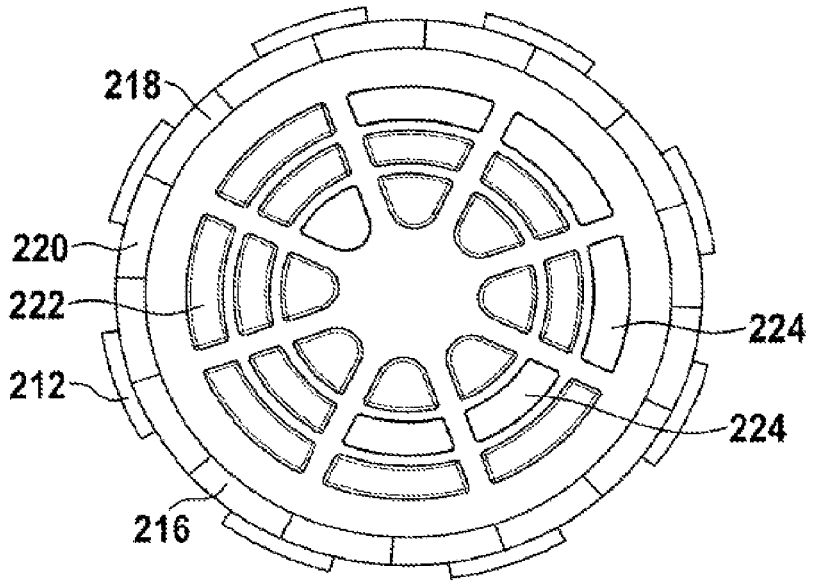

FIG. 2D shows the second drum 106 from FIG. 2C from below. The underside 222 of the drum 106 associated with the end 214 has a plurality of openings 224 so as to connect the chambers 120, 122 to the mixing chamber 124 of the first drum 108 so as to conduct liquid, gas and/or particles ("conductively" hereinafter). Alternatively or in addition, the openings 224 can also conductively connect the chambers 120, 122 to the chamber 126 of the first drum 108. A respective conductive connection is determined by the position of a respective opening 224 in relation to the chambers 124, 126. This position is achieved by rotating the first drum 108 relative to the second drum 106, as will be explained in greater detail hereinafter.

Figure 2E:
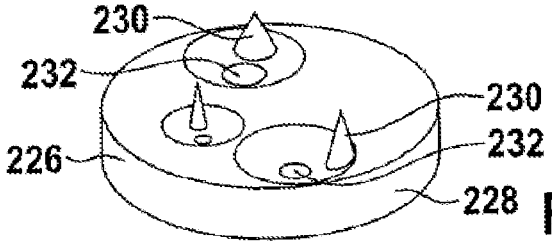

FIG. 2E shows a lancet device 226, which is not illustrated in FIG. 1. The lancet device 226 comprises a plate 228 having one or more mandrels 230 which are each arranged beside an opening 232 in the plate 228. The mandrels 230 are used to pierce a respective opening 224 in the underside 222 of the second drum 106 by means of suitable control by the actuator 139, whereupon in particular liquid from the corresponding chamber 120, 122 flows through the opening 232 and into the chambers 124 or 126.

Figure 2F:
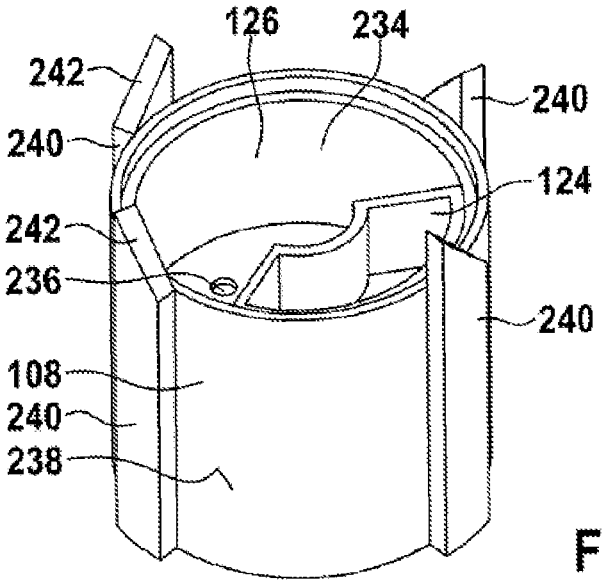

FIG. 2F shows the first drum 108 with the chambers 124, 126. For example, an opening 236 for conductive connection of the chamber 126 to the chambers 132, 136 of the third drum 110 is provided in the base 234 of the chamber 126. The first drum 108 has a plurality of protrusions 240 on its outer wall 238. The protrusions 240 are designed to engage in the slits 204 (just like the protrusions 212 of the second drum 106). Provided the protrusions 240 are engaged with the slits 240, rotation of the first drum 108 about the longitudinal axis 104 is blocked. However, the protrusions 240 and the drum 108 are movable in the slits 204 along the longitudinal axis 104. The protrusions 240 have slanted edges 242, which point towards the center of rotation 140 during operation of the centrifuge with the cartridge 100 and which are formed so as to correspond to the slanted edges 206 and 220.

Figure 2G:
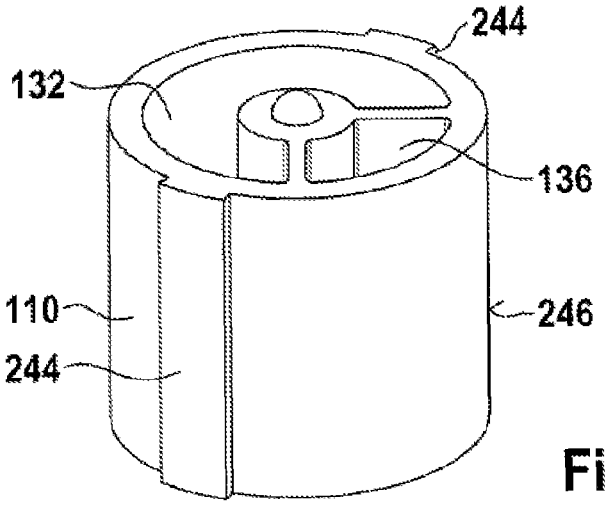

FIG. 2G shows the third drum 110 with the chambers 132, 136. The drum 110 has protrusions 224, which each protrude from the outer wall 246 of the drum 110. The protrusions 244 are designed to engage in the grooves 208 in the end 112 so that the drum 110 is displaceable in the grooves 208 in the longitudinal direction 104. Rotation of the drum 110 about the longitudinal axis 104 is thus blocked, however.

Figure 3A:
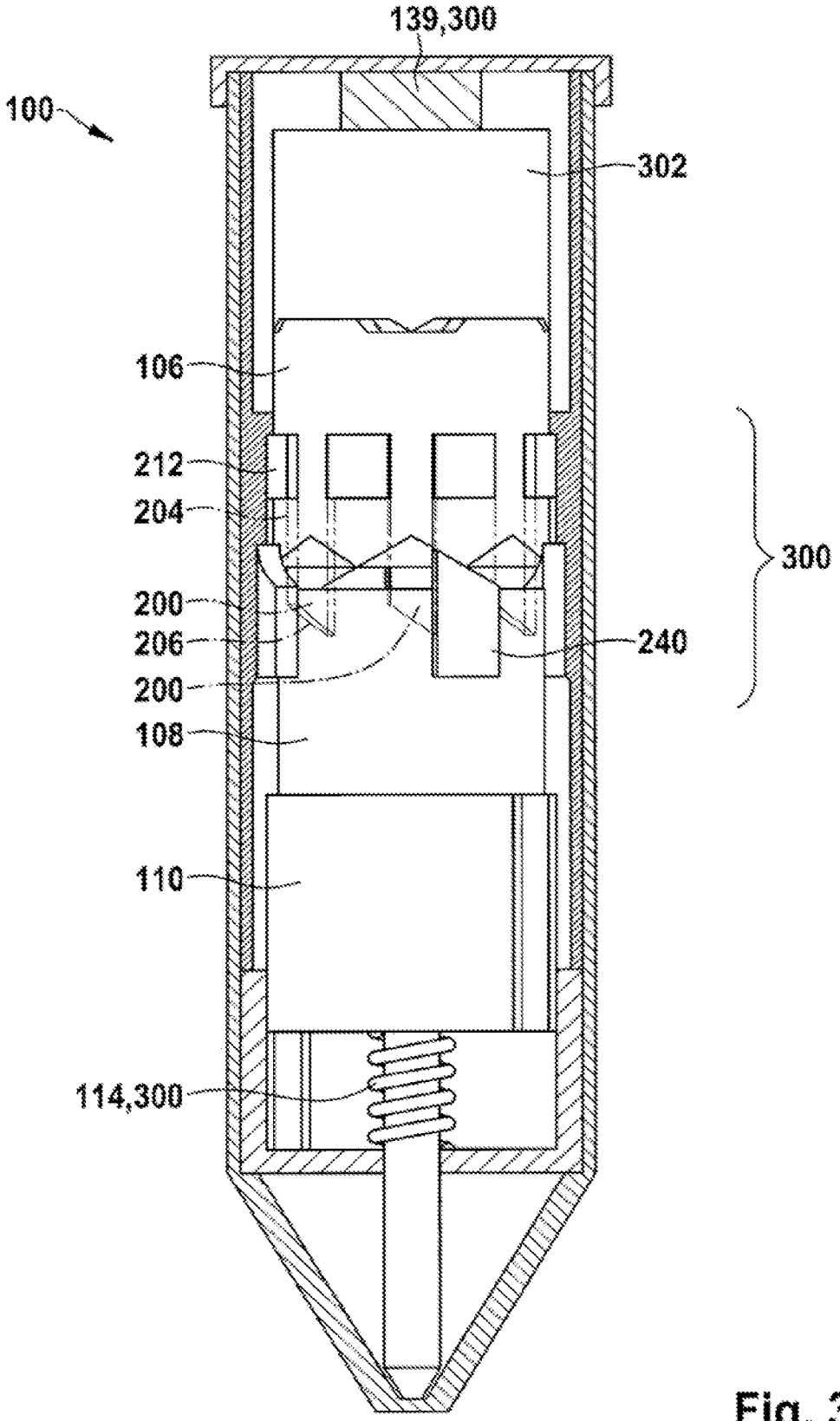
FIGS. 3A to 3E show different operating states of the cartridge from FIG. 1.
Figure 3B:
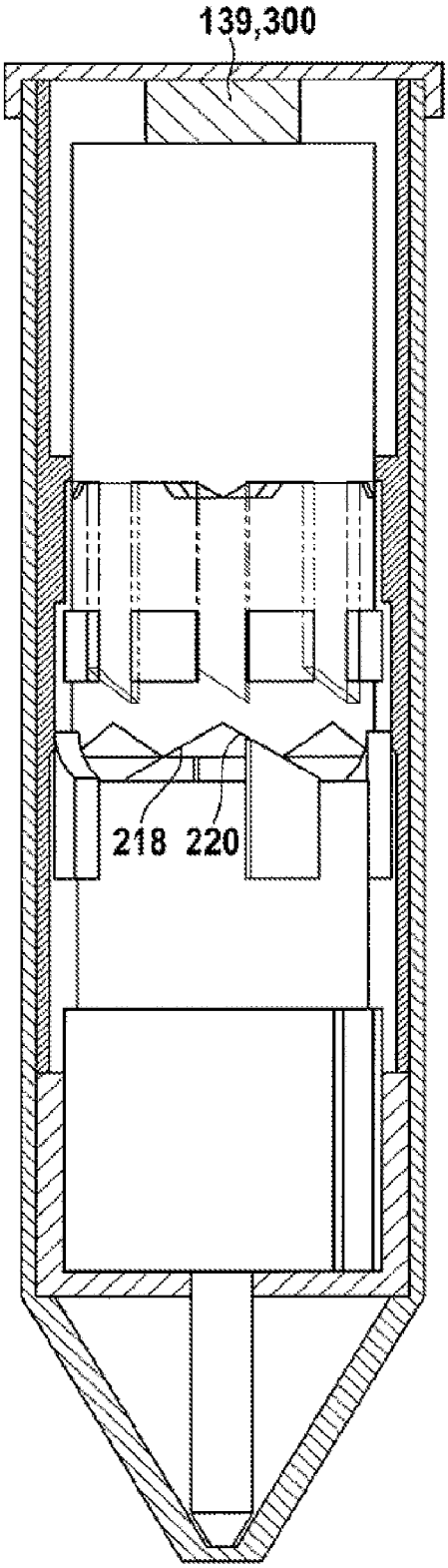
Figure 3C:
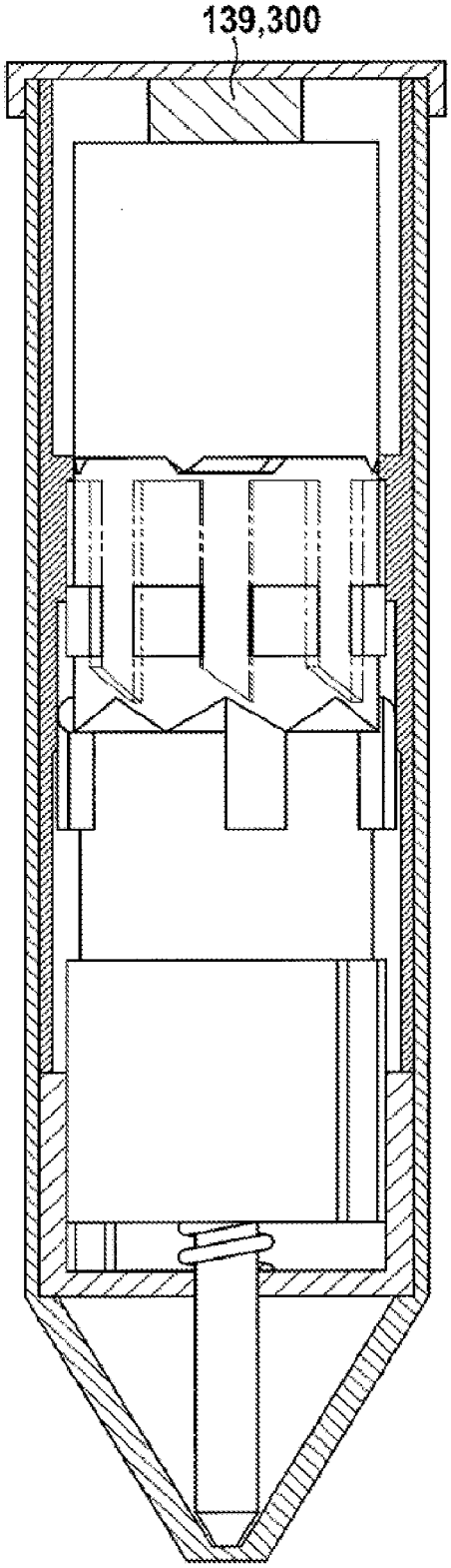
Figure 3D:
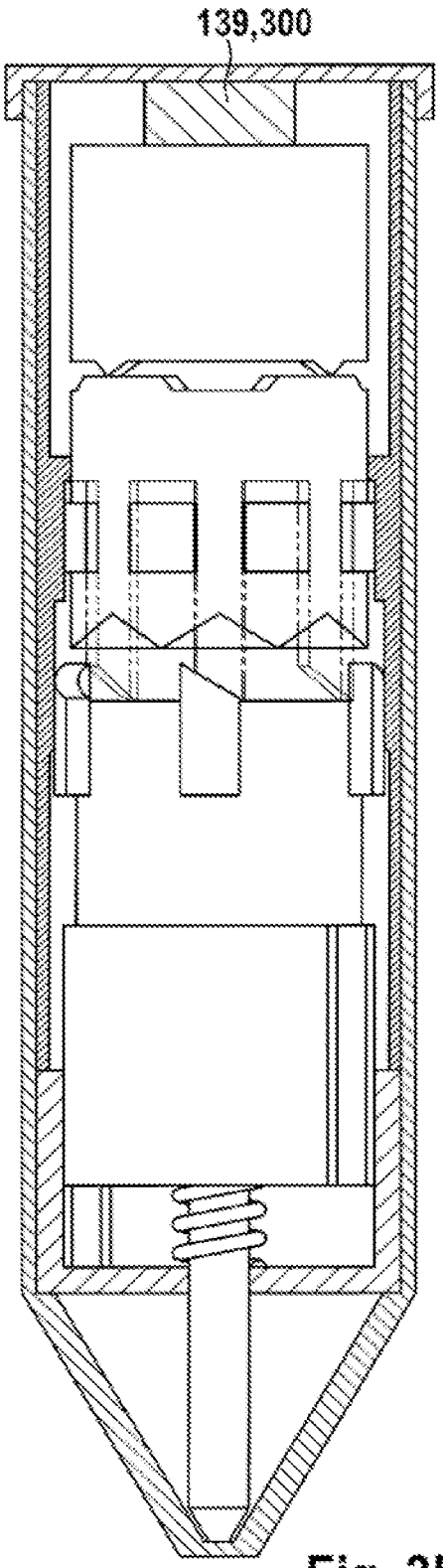
Figure 3E:
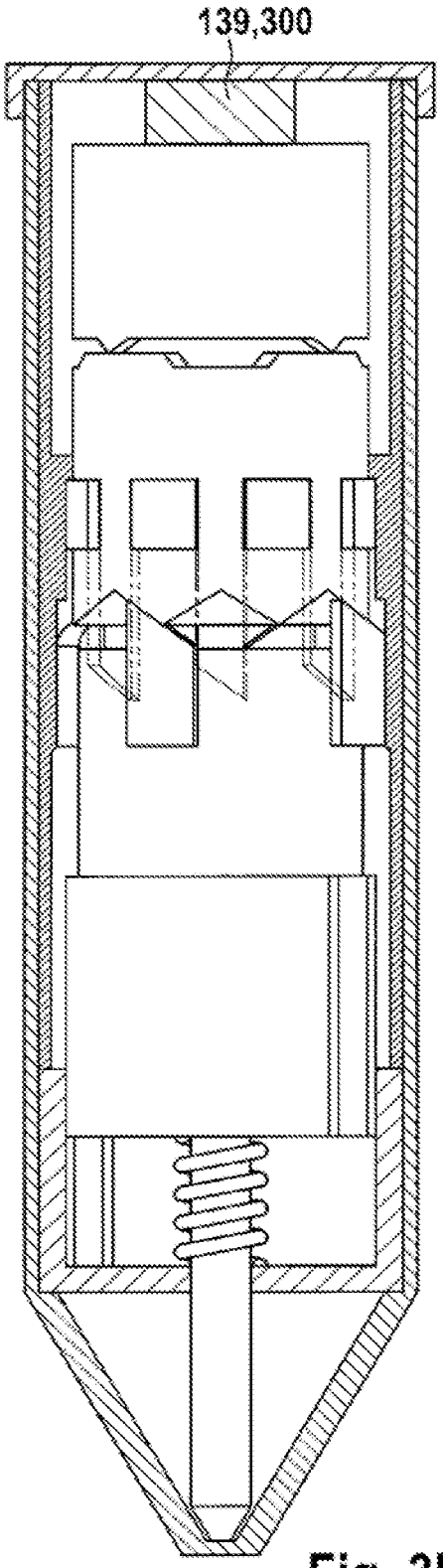

FIGS. 3A to 3E show a number of operating states during operation of the cartridge 100 from FIG. 1, wherein an additional drum 302 is illustrated, which is of no further relevance in the present case however. FIGS. 4A to 4E correspond to FIGS. 3A to 3E respectively and illustrate the movement of the slanted edges 206, 218, 220, 242 relative to one another. However, it should also be noted that FIG. 3B shows a more advanced operating state of the cartridge 100 compared to the state shown in FIG. 4B. In FIGS. 3A to 3E, the housing 102 is illustrated transparently in part so as to show the interior.

The actuator 139, the protrusions 200, the slits 204, the slanted edges 206, the protrusions 212, the slanted edges 218, 220, the protrusions 240 and the slanted edges 242 form the above-mentioned displacement device 300, together with the restoring spring 114, for defined rotation of the first drum 108 relative to the other drums 106, 110 about the longitudinal axis 104.

Figures 4A, 4B, 4C, 4D, 4E:
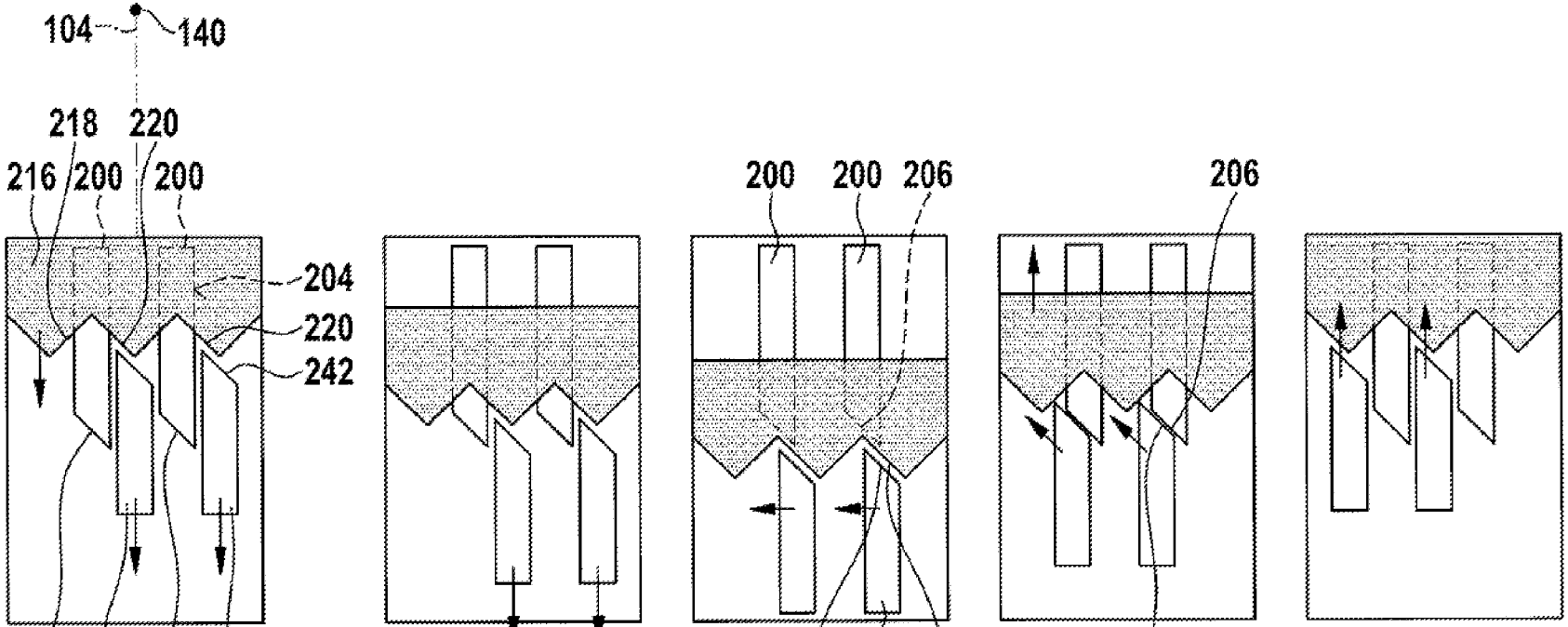

FIGS. 3A and 4A show a first position, in which the protrusions 240 of the first drum 108 engage in the slits 204, thus blocking rotation of the first drum 108 about the longitudinal axis 104. If the actuator 139 presses directly or indirectly against the second drum 106, the second drum 106 in turn presses against the slanted edges 242 of the first drum 108 by means of the slanted edges 220 of the contour 216, against the action of the spring 114, thus compressing the spring 114. The first drum 108 thus moves away from the center of rotation 140, as indicated by the corresponding arrows in FIGS. 4A and 4B. This movement is continued until the protrusions 240 become disengaged from the protrusions 200. In this second position, rotation of the first drum 108 about the longitudinal axis 104 is released, as illustrated in FIG. 4C. Due to the cooperation between the slanted edges 220 and 242, which for example are each oriented at an angle of 45° to the longitudinal axis 104, a force component is produced, which automatically rotates the first drum 108 when said drum reaches the second position, as indicated by arrows directed to the left in FIG. 4C.

If the actuator 139 now releases the second drum 106, the spring 114 thus presses the first drum 108 by means of the third drum 110 back towards the center of rotation 140. The second drum 106, together with its slanted edges 220, is thus likewise moved back towards the center of rotation 140, whereby the slanted edges 242 of the first drum 108 come to lie against the slanted edges 206 of the housing 102 and slide along these slanted edges, thus implementing a further rotational movement of the first drum 108 into a third position, as illustrated in FIGS. 4D and 4E. In the third position, the protrusions 240 of the first drum 108 are again arranged in the slits 204 in the housing 102 so that further rotation of the first drum 108 about the longitudinal axis 104 is blocked again.

The above-described process can be repeated as often as desired, so as to rotate the first drum 108 in a defined manner relative to the other drums 106 and 110.

Alternatively again, a further actuator (not illustrated) could also be used instead of the restoring means 114.

In principle, the actuator 139 can be operated electrically, mechanically and/or by pressure. In particular, a piezoelectrically, electrostatically, semi-mechanically/manually or electromagnetically operated actuator 139 can be considered. In this case, "operated" means the active principle utilized by the actuator 139 to produce the actuation force for actuation of the first drum 106 (or of one of the other drums 108, 110 depending on the embodiment). For example, the actuator 139 may have an electromagnet, which cooperates with a metal part arranged in one of the drums 106, 108, 110, said metal part attracting or repelling the electromagnet by means of suitable control thereof so as to thus achieve the relative displacement of the drums 106, 108, 110 explained above. The compressive force applied to the second drum 106 by means of the actuator 139 is typically 0.5 to 100 N. The compressive force to be applied by the actuator reduces in accordance with the effective centrifugal force.

A suitable control device (not illustrated) is preferably provided and controls the actuator 139 in such a way that the drums 106, 108, 110 adopt the respective desired position relative to one another at the desired moment in time. To this end, the control device may have a timer and/or an integrated circuit.

FIG. 5 again shows the cartridge 100 from FIG. 1 in a sectional, but schematic, view.

In the exemplary embodiment according to FIGS. 1 to 5, the actuator 139 is preferably formed as a piezoelectric element which is arranged between the cover 118, which faces the center of rotation 140, and the second drum 106. The actuator 139 is fastened to the cover 139 and also presses, via its end face 500, against the drum 106 in a planar manner, but is not connected to said drum. The end face 500 is illustrated at a distance from the drum 106, merely for the sake of improved explanation. In fact, however, the restoring means 114 continuously presses the drum 106 against the actuator 139.

For example, the cartridge 100 is rotated at a constant rotational speed about the center of rotation 140. The rotational speed is selected in such a way that the first drum 108 is not rotated automatically relative to the other drums 106, 110, that is to say the ballpoint mechanism is not triggered merely on the basis of the centrifugal force 142.

Thereafter, the actuator 139 is controlled by means of a corresponding control signal from the control device to exert a force onto the second drum 106. Due to the above-described cooperation between the slanted edges 206, 220, 242 and the restoring means 114 ("ballpoint mechanism"), the first drum 108 is rotated in such a way that the chambers 120, 124 are mutually opposed and are interconnected conductively. For example, a cover film (not illustrated) which is provided where necessary and seals the chambers 120, 124 is pierced by means of mandrels 230 during this process. A first component 502 thus flows from the chamber 120 into the mixing chamber 124 under the effect of the centrifugal force 142. Hereafter, the ballpoint mechanism is again actuated by means of the actuator 139, whereupon the first drum 108 rotates in such a way that the mixing chamber 124 opposes the chamber 122 and is conductively connected thereto. A cover film, which seals the chamber 122, as described above, and which is pierced during this process may likewise be provided. A second component 504 thus flows from the chamber 122 into the mixing chamber 124 under the effect of the centrifugal force 142, where it can then be mixed. The movement of the respective components 139, 106, 108, 110 is indicated by arrows.

The rotation of the first drum 108, and thus the processing of the components 502, 504, therefore can take place largely independently of the centrifugal force 142.

Figure 5:
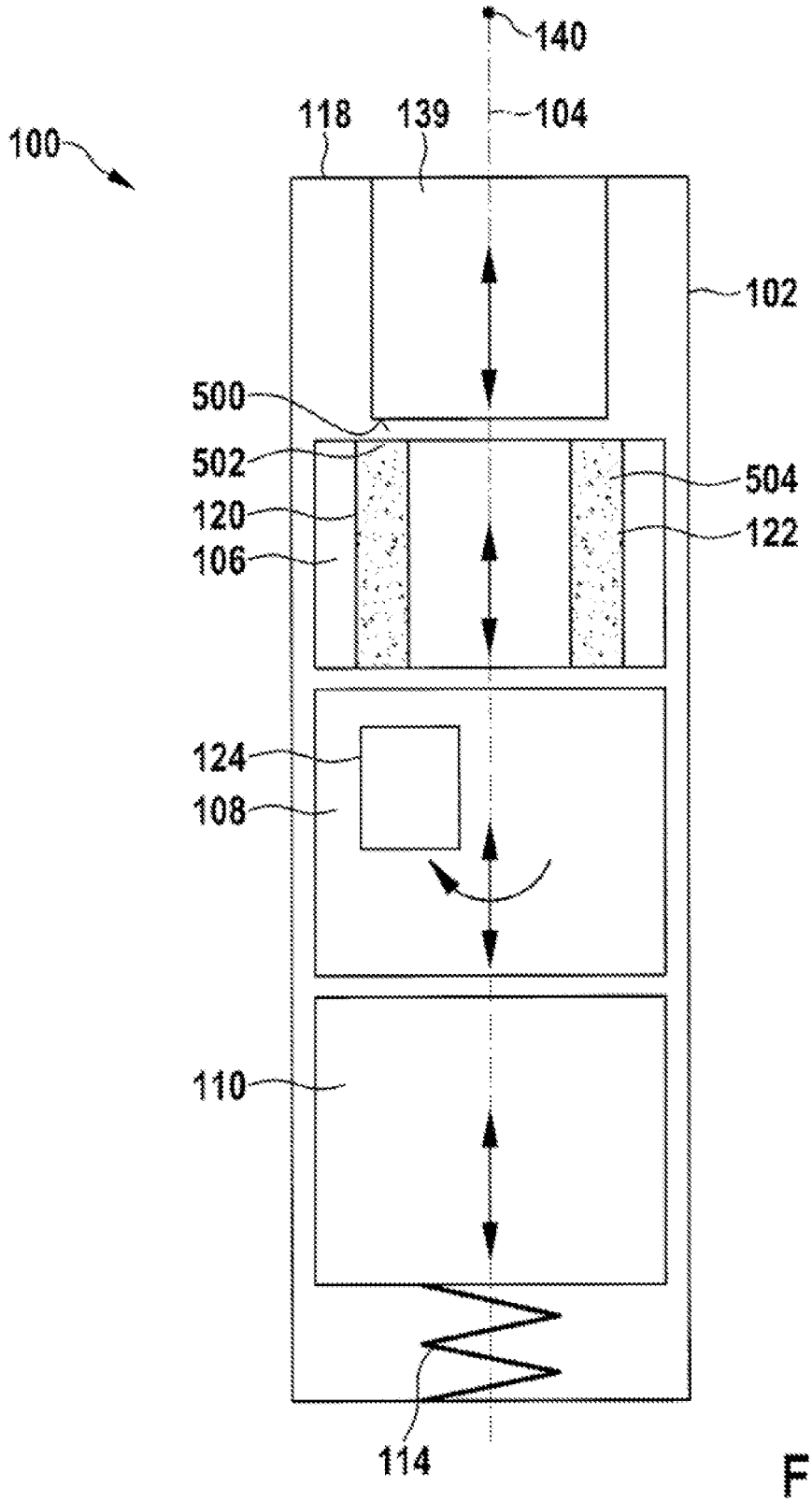
FIG. 5 again shows the cartridge from FIG. 1 in a sectional, but schematic, view.
Figure 6:
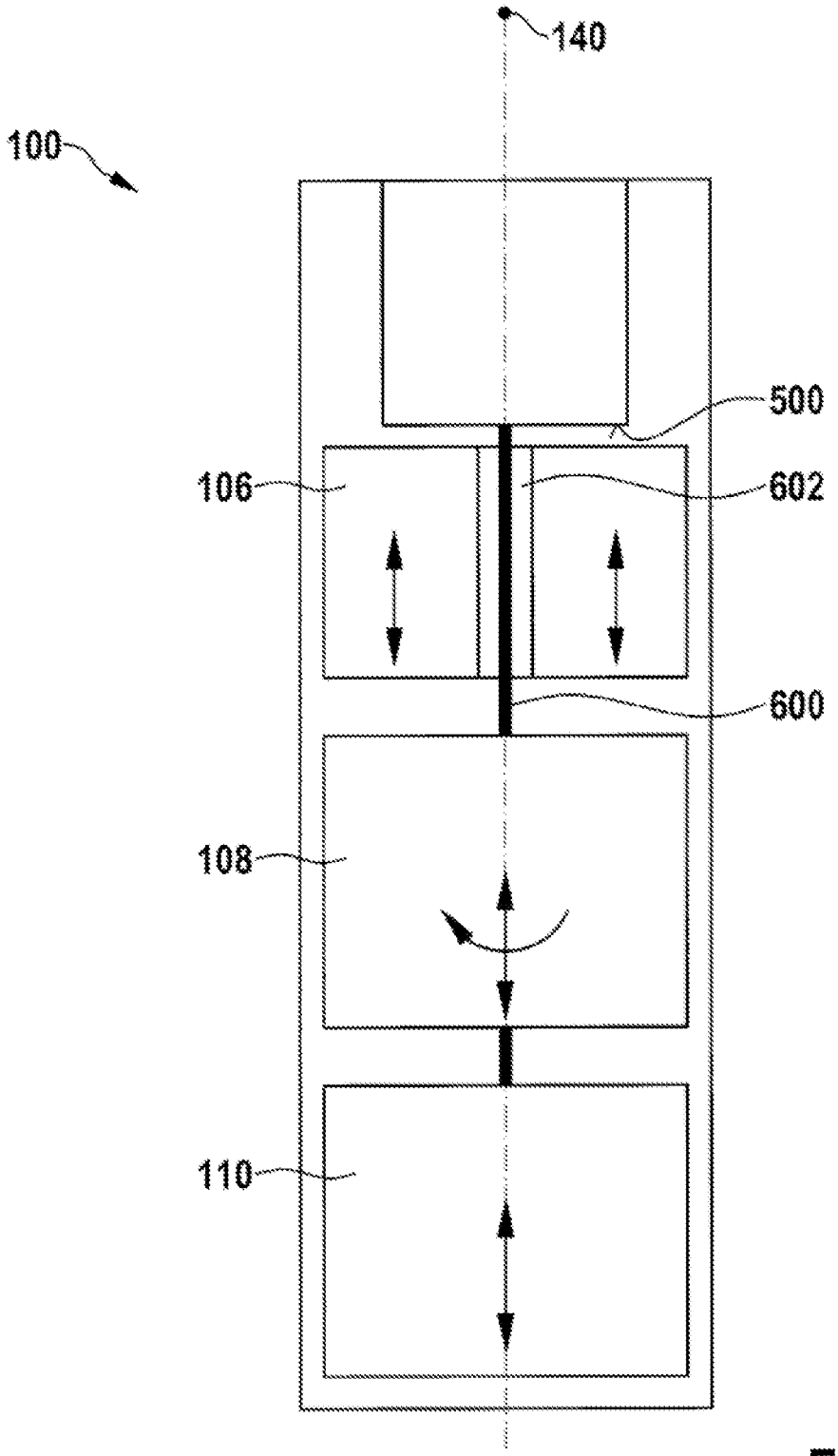
FIG. 6 shows a variant of FIG. 5, wherein the actuator comprises a shaft.

FIG. 6 shows a variant of FIG. 5.

Compared to the exemplary embodiment according to FIG. 5, a control element 600 is additionally provided, which is fastened to the end face 500 of the actuator and to the third drum 110. The control element 600 extends through a bore 602 in the second drum 106 and is connected to the first drum 108 and/or to the third drum 110. The restoring force is generated by the control element 600, and therefore the spring 114 can be omitted (see FIG. 5). As a result of contraction of the actuator 139, the control element 600 and therefore the drum 108, is drawn upwardly. For the rest, the first drum 108 is rotated as in the exemplary embodiment according to FIG. 5.

Figure 7:
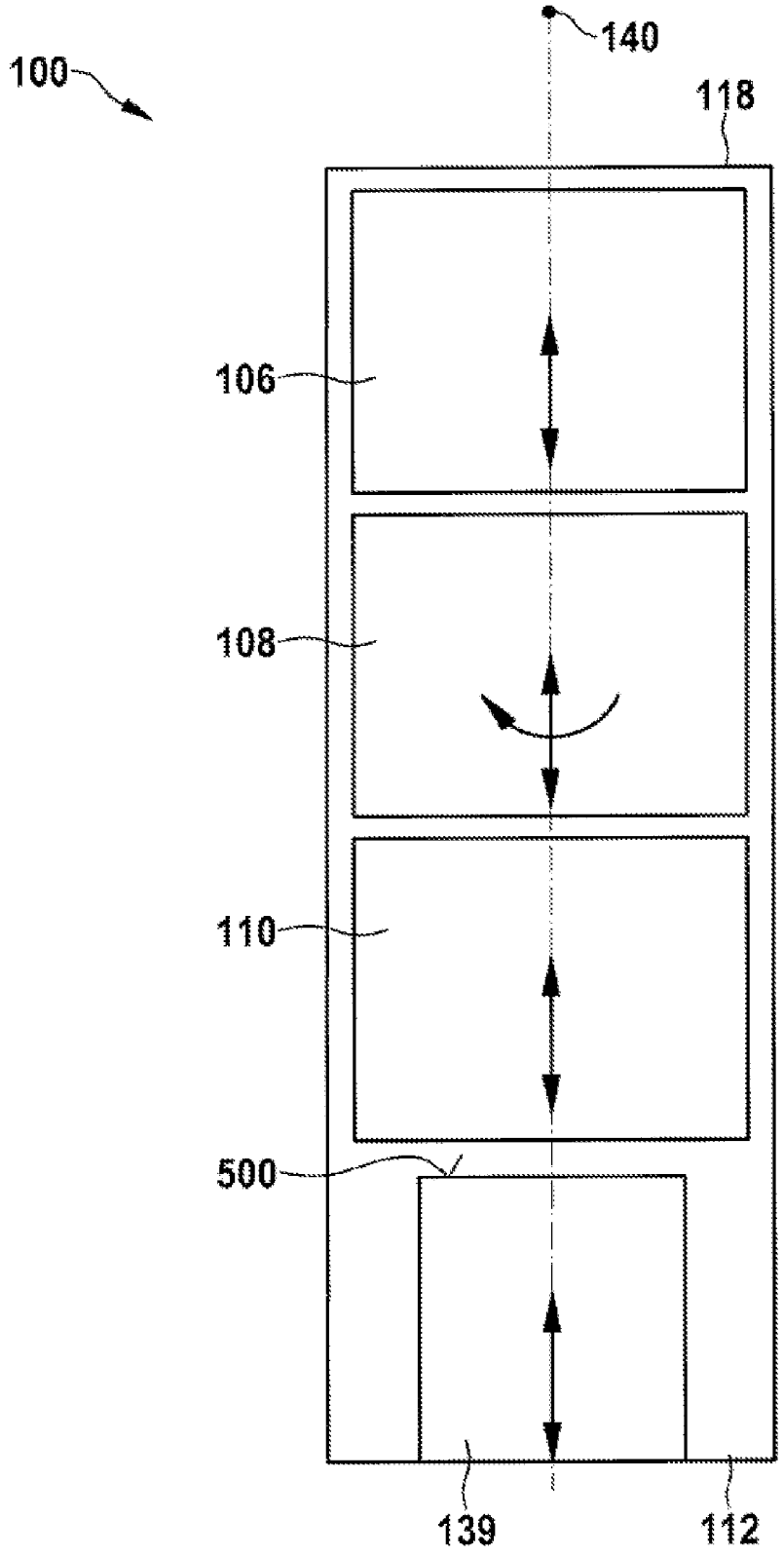
FIG. 7 shows a variant of FIG. 5, without a spring.

FIG. 7 shows a further variant of FIG. 5.

Whilst, in the exemplary embodiment according to FIG. 5, the actuator 139 is arranged between the center of rotation 140 and the second drum 106 or the first drum 108, in the exemplary embodiment according to FIG. 7 the actuator 139 is arranged between the end 112 of the housing 102 and the third drum 110. In this exemplary embodiment, the ballpoint mechanism is actuated and restored by means of the actuator 139 or alternatively in combination with the centrifugal force 142.

Figure 8:
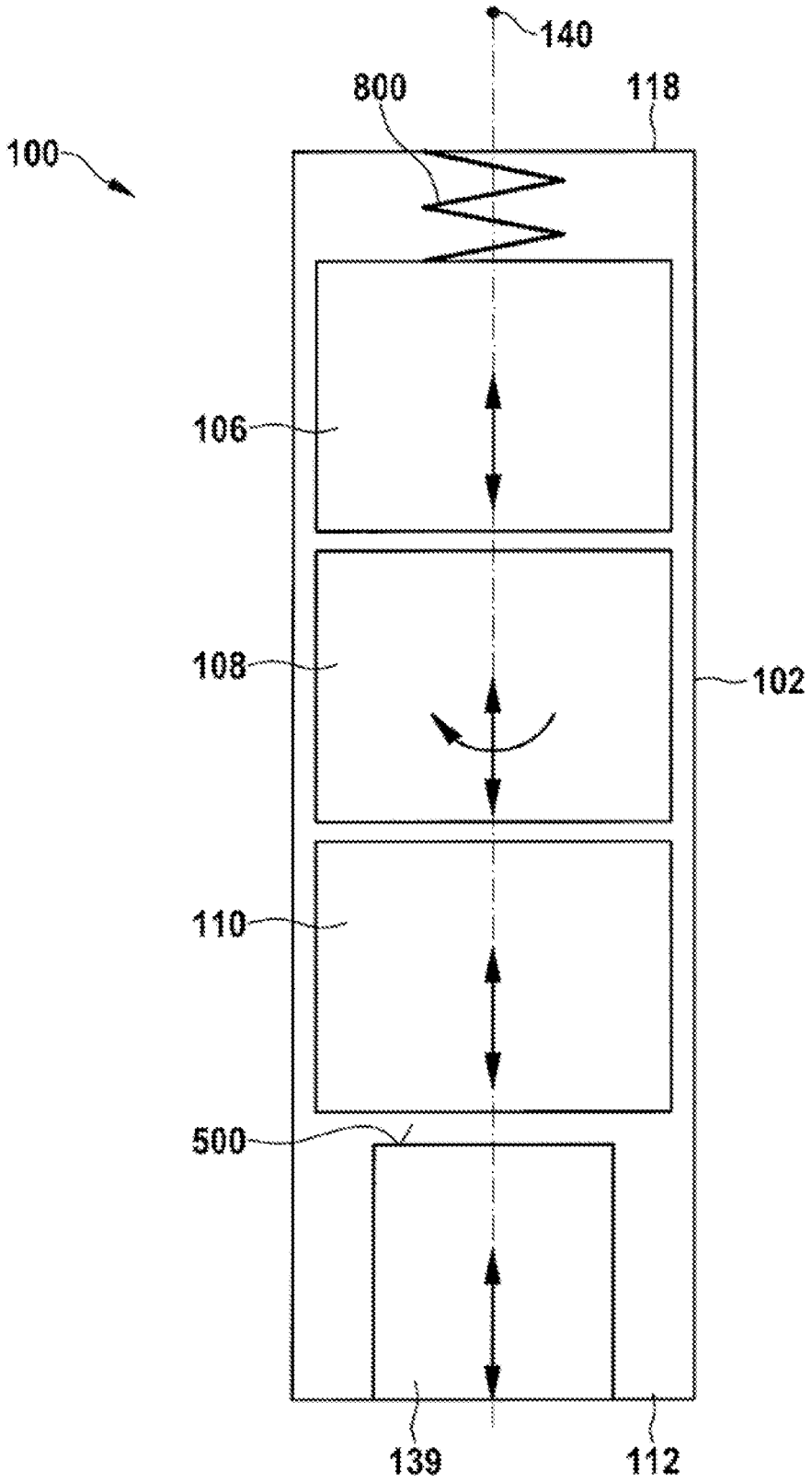
FIG. 8 shows a further variant of FIG. 5, wherein the arrangement of actuator and spring has been swapped.

If the available centrifugal force 142 is not sufficient (for example because the centrifugal force 142 is to be kept constant), a spring 800 can additionally be provided between the cover 118 of the second drum 106 and biases the drums 106, 108, 110 against the actuator 139. This is shown in FIG. 8, which illustrates a variant of FIG. 7.

Figure 9:
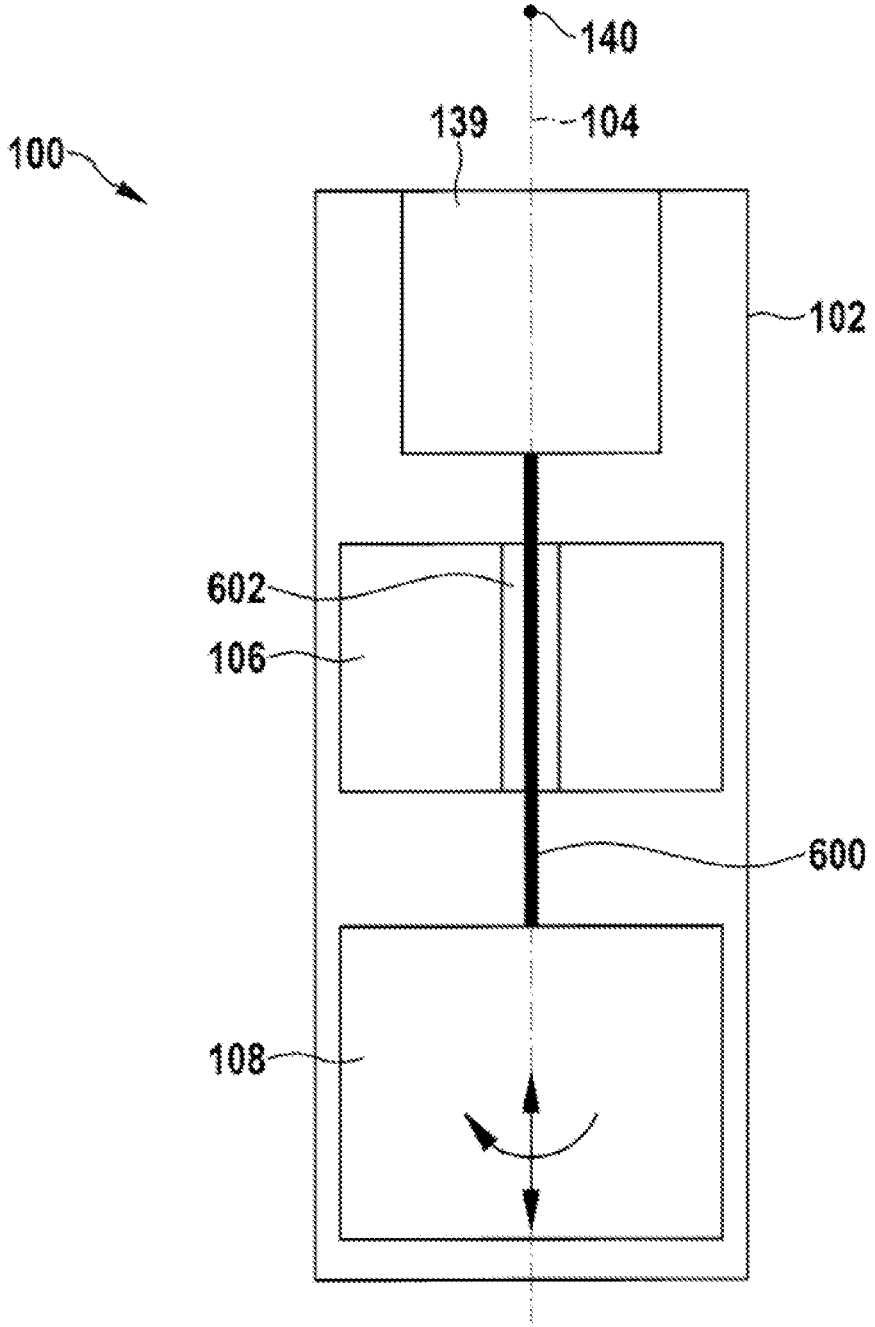
FIG. 9 shows a further variant of FIG. 5, wherein the actuator comprises a shaft and no ballpoint mechanism is provided.

FIG. 9 shows a further variant of FIG. 5.

In the exemplary embodiment according to FIG. 9, merely the first drum 108 and the second drum 106 are provided. A control element 600 in the form of a shaft is connected to the actuator 139 and also to the first drum 108. The shaft 600 passes through a bore in the second drum 106, which is stationary in accordance with this exemplary embodiment. The actuator 139, in particular an electric motor, rotates the shaft 600, and thus the first drum 108, about the center axis 104, whereby different chambers 120, 122, 124 are interconnected conductively, as described above. A ballpoint mechanism is not provided in this exemplary embodiment. The actuator 139 can also be designed to move the shaft 139 along the center line 104 so as to thus distance the first drum 108 from the second drum 106 for rotation and, after rotation, to press the drums 106, 108 back against one another, whereby a tight, conductive connection is provided, for example between the chamber 120 and the chamber 124.

In accordance with another exemplary embodiment, the second drum 106 can be movable by means of a further actuator (not illustrated).

Figure 10:
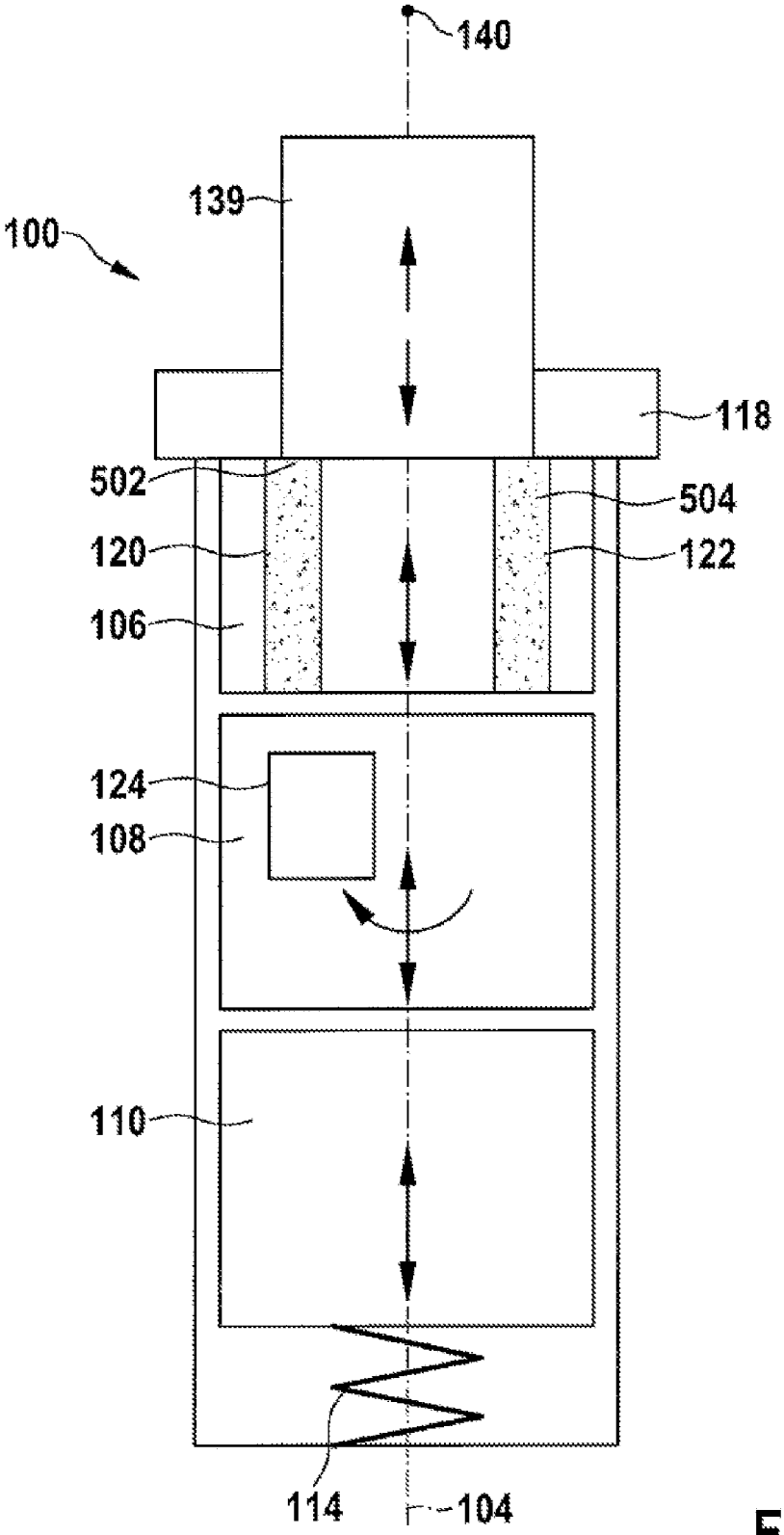
FIG. 10 shows a further variant of FIG. 5, wherein the cover of the housing is formed as an adapter.

FIG. 10 shows a further variant of FIG. 5.

In the exemplary embodiment according to FIG. 10, the cover 118 is formed as an adapter for holding the actuator 139. The actuator 139 extends through the adapter 118 and therefore engages directly in the second drum 106, so as to move said drum away from the center of rotation 140, that is to say downwardly in FIG. 11. For example, the actuator 139 may have a control element for this purpose, in particular a rod, which presses against the drum 106. The restoring operation can take place as described above by means of the restoring means 114.

Alternatively, the actuator 139, for example the control element, is connected rigidly to the second drum 106. The drum 106 can thus move quickly to and fro along the longitudinal axis 104 by means of the actuator 139, whereby a mixing chamber for mixing components could be provided in one of the chambers 120, 122. If the amplitude of the movement to and fro is selected to be sufficiently small, this movement can occur without rotation of the drums 106, 108, 110 relative to one another, that is to say without triggering of the ballpoint mechanism.

Figure 11:
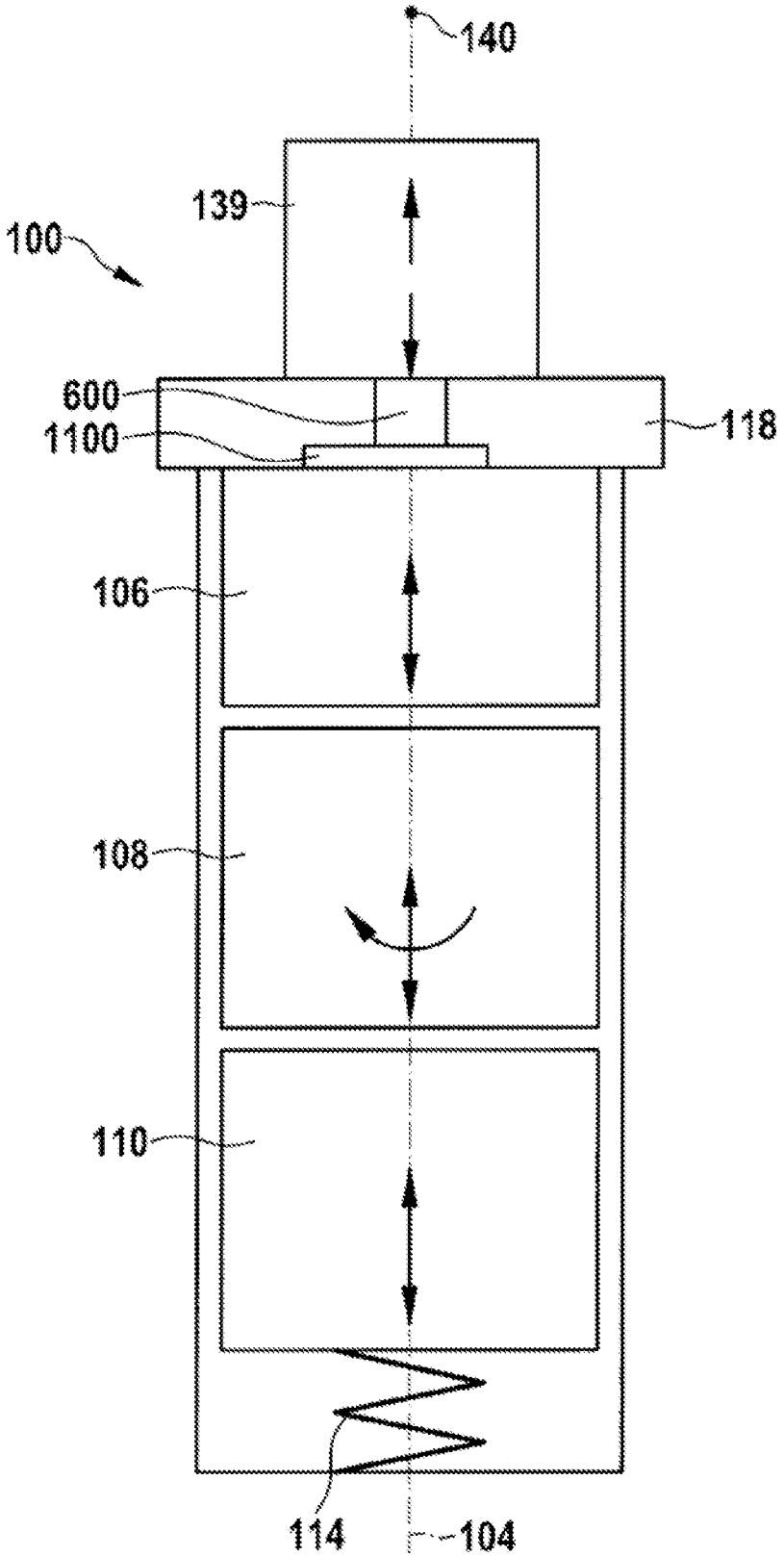
FIG. 11 shows a further variant of FIG. 10, wherein the adapter is formed with a membrane.

The exemplary embodiment according to FIG. 11 differs from that according to FIG. 10 in that the actuator 139 is attached externally to the adapter 118, that is to say, in this case, the actuator 139 does not penetrate through the adapter 118. Rather, the actuator 139 acts indirectly on the second drum 106, for example by means of a flexible membrane, so as to actuate said drum in the first direction 207. To this end, a portion 1100 of the adapter 118 is formed so as to be thin in particular, wherein a control element 600 actuated by the actuator 139 elastically deforms this thin portion 100.

Furthermore, it is possible to provide the actuator 139 in a pressure-operated manner, for which purpose the actuator is connected in a pressure-conducting manner to a pressure device (not illustrated), for example a gas pressure cylinder, and is driven thereby. In the simplest case, the adapter 118 and the second drum 106 together form a chamber, which is pressurized by the pressure device and thus forms the actuator 139. Furthermore, the actuator 139 could be provided in the form of a bellows, which is provided between the adapter 118 and the second drum 106.

The actuator 139 can also be provided at another point, for example between the first drum 108 and the second or third drum 106, 110. In addition, the actuator 139 is preferably formed as a piezoelectric element.

Figure 12:
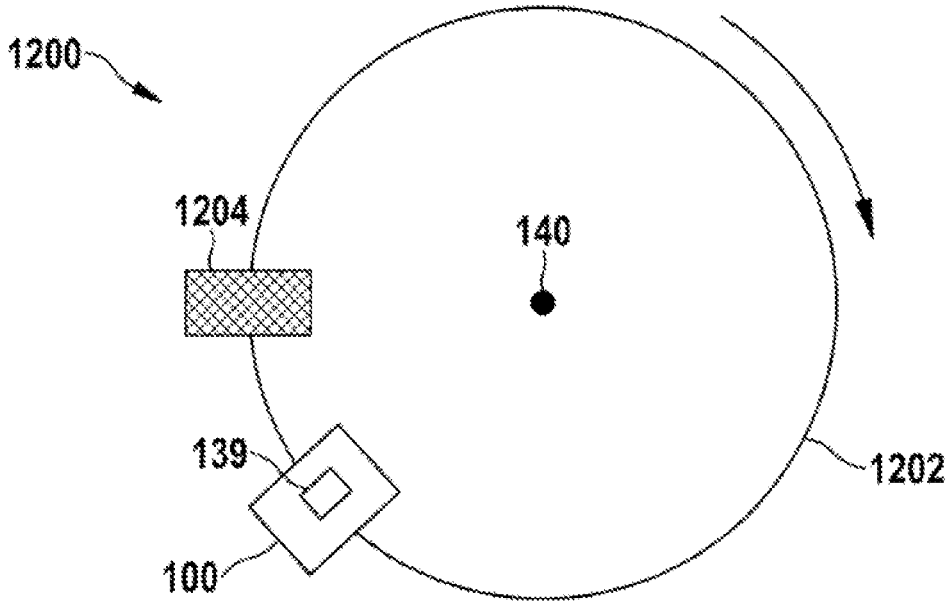
FIG. 12 shows a schematic view of a centrifuge in accordance with an exemplary embodiment of the present disclosure.

FIG. 12 shows a schematic plan view of a centrifuge 1200 according to an exemplary embodiment of the present disclosure.

The centrifuge 1200 comprises a rotor (not illustrated in greater detail). The cartridge 100 is inserted into the rotor and is moved over a circular path 1202. A coil 1204 is provided along the circular path 1202 and controls the actuator 139 as soon as said actuator passes the coil 1204. The actuator 139 then triggers the above-described rotational movement of the first drum 108.

A transmitter device (not illustrated) which generates electromagnetic waves, in particular radio waves, of short range could be provided instead of the coil 1204. A receiver device (not illustrated) integrated into the cartridge 100 controls the actuator 139 as soon as said actuator passes the transmitter device.

In principle, the actuator 139 can thus be controlled wirelessly by a stationary control device, for example provided in the centrifuge housing. Control by means of sliding contact is also possible, however.

Alternatively, the cartridge 100 could have a processor unit (not illustrated), which controls the actuator 139 on the basis of a computer program. For example, a start time of the computer program can be determined by a user or can be transferred to the processor device wirelessly by means of the above-mentioned control device.

An energy supply (not illustrated) for the actuator 139 can be integrated into the cartridge 100, for example in the form of a battery in the housing 102. Electrical energy can be fed externally in a wireless or wired manner. For example, the energy can be induced (wirelessly) by means of one or more coils. Or, the energy can be fed (in a wired manner) via a sliding contact.

A control unit (not illustrated) controls the cooperation between the actuator 139, which defines the spatial positioning of the drums 106, 108, 110, and the rotational speed of the centrifuge 1200 or of the rotor, which in particular controls the flow rate of the components 502, 504 through the cartridge 100.

In the exemplary embodiments described above, different chambers can advantageously be interconnected, that is to say they can be conductively interconnected, independently of the rotational speed of the rotor of the centrifuge 1200. This interconnection can be achieved for example at constant, increasing or decreasing rotational speed.

Depending on the embodiment, the second drum 106 and/or the third drum 110 can be stationary or movable in relation to the housing 102. For example, the drums 106, 110 may each be rotatable about the center axis 104 by means of a further actuator.

Furthermore, the mixing chamber 124 may have an obstruction structure (not illustrated), for example a screen or a lattice structure, which is designed to move through the liquids 502, 504 under the effect of a centrifugal force (that is to say when the rotational speed of the centrifuge exceeds a predetermined threshold value), so as to mix said liquids.

The housing 102 and the drums 106, 108, 110 can be produced from the same or from different polymers. The one or more polymer(s) is/are thermoplastics, elastomers, or thermoplastic elastomers in particular. Examples include cyclic olefin polymer (COP), cyclic olefin copolymer (COC), polycarbonates (PCs), polyamides (PAs), polyurethanes (PUs), polypropylene (PP), polyethylene terephthalates (PETs) and poly(methyl methacrylates) (PMMAs).

The second drum 106 and/or the third drum 110 can be formed in one piece with the housing 102.

Although the disclosure has been described herein on the basis of preferred exemplary embodiments, it is in no way limited thereto, but can be modified in many ways. In particular, it is noted that the embodiments and exemplary embodiments described herein for the cartridge according to the disclosure are accordingly applicable to the centrifuge according to the disclosure and to the method according to the disclosure for mixing a first and a second component, and vice versa. It is also noted that "a" and "an" do not exclude a plurality in the present case.

What is claimed is:

1. A cartridge configured for insertion and centrifugation in a centrifuge, comprising:

a first drum having one or more chambers and defining a center axis, one or more additional chambers defined in the cartridge, and a displacement device configured to rotate the first drum about said center axis to selectively connect at least one of the one or more chambers to at least one of said one or more additional chambers to conduct one or more of a liquid, a gas, and particles, wherein the displacement device has an actuator configured to rotate the first drum about the center axis.

2. The cartridge according to claim 1, wherein the actuator is one or more of electrically operated, mechanically operated, and operated by pressure.

3. The cartridge according to claim 1, wherein the actuator has a control element which is connected to the first drum and is configured to one or more of rotate the first drum directly and move the first drum along the center axis.

4. The cartridge according to claim 1, wherein the actuator has a control element which is connected to the first drum and configured to move the first drum along the center axis to rotate the first drum by operation of the displacement device.

5. The cartridge according to claim 1, wherein the displacement device includes a first slanted edge which cooperates with a second slanted edge of the first drum to bring the drum out of a first position, in which the drum engages with a positive fit with a housing of the cartridge in the direction of rotation about the center axis, and into a second position along the center axis, in which the positive fit is annulled and the first drum rotates about the center axis due to the action of one of a restoring mechanism, the actuator, and a further actuator.

6. The cartridge according to claim 5, wherein the actuator actuates the first slanted edge to cooperate with the second slanted edge.

7. The cartridge according to claim 1, wherein a second drum is arranged upstream or downstream of the first drum, based on the center axis, the actuator being configured to actuate the second drum to rotate the first drum.

8. The cartridge according to claim 1, wherein the actuator lies against one or more of the first drum and a second drum to press thereagainst in a planar manner or is connected rigidly to the first drum or the second drum.

9. The cartridge according to claim 1, wherein the actuator is arranged between the first drum and a second drum.

10. The cartridge according to claim 1, further comprising a housing which is sealed at one end by an adapter, the actuator being fastened to the adapter.

11. The cartridge according to claim 10, wherein the adapter has a flexible membrane which is configured to be actuated on one side by the actuator and which, on another side, is configured to act on the first drum or on a second drum.

12. The cartridge according to claim 1, wherein one or more of said one or more additional chambers are arranged upstream or downstream of the first drum, based on the center axis, and formed in a second drum.

13. A centrifuge, comprising:

a cartridge including:

a first drum having one or more chambers and defining a center axis, and a displacement device configured to rotate the first drum about said center axis to selectively connect at least one of the one or more chambers to at least one of one or more additional chambers to conduct one or more of a liquid, a gas, and particles, wherein the displacement device has an actuator configured to rotate the first drum about the center axis.

14. The centrifuge according to claim 13, wherein the actuator is arranged in front of or behind the first drum, based on a center of rotation of the cartridge in the centrifuge.

* * * * *